United States Patent [19]

Massé

[11] Patent Number: 4,762,188

[45] Date of Patent: Aug. 9, 1988

[54] DRILL BIT

[76] Inventor: Roger Massé, 131 Roussin St., Thetford Mines, Quebec, Canada, G6G 1N6

[21] Appl. No.: 12,683

[22] Filed: Feb. 9, 1987

[51] Int. Cl.[4] ..... E21B 10/10; E21B 10/16; E21B 10/36

[52] U.S. Cl. ..... 175/361; 175/376; 175/378; 175/414

[58] Field of Search ..... 175/331, 327, 343, 361, 175/363, 364, 350–355, 357–359, 373, 381, 376–378, 397, 398, 413–415, 319; 299/62, 94

[56] References Cited

U.S. PATENT DOCUMENTS

| | | | |
|---|---|---|---|
| 223,230 | 1/1880 | Jenkins | 175/363 |
| 1,868,348 | 7/1932 | De Costa | 175/357 |
| 4,167,980 | 9/1979 | Saxman | 175/372 X |
| 4,682,819 | 7/1987 | Masse | 299/10 |

FOREIGN PATENT DOCUMENTS

| | | | |
|---|---|---|---|
| 110460 | 2/1908 | Canada . | |
| 330634 | 3/1933 | Canada . | |
| 1133954 | 10/1982 | Canada . | |
| 2108594 | 5/1983 | United Kingdom . | |
| 303409 | 7/1971 | U.S.S.R. | 175/318 |

OTHER PUBLICATIONS

TRW Distributors Catalogue (undated),—p. 13 and another unnumbered page.

*Primary Examiner*—Stephen J. Novosad
*Assistant Examiner*—Hoang C. Dang
*Attorney, Agent, or Firm*—Robic, Robic & Associates

[57] ABSTRACT

A drill bit for use with a reciprocating device, wherein the bit is in the form of a rotatable corrugated frusto-conical roller, supported by a U-shaped member, attached to a mounting post. The corrugations are the cutting edges of the bit.

11 Claims, 1 Drawing Sheet

DRILL BIT

This invention relates to a drill bit for use with a reciprocating device, wherein the bit is in the form of a corrugated frusto-conical roller, supported by a U-shaped member attached to a mounting post.

Corrugated frusto-conical rollers are presently used to crush hard material such as rock by rolling a roller across the surface to be crushed. Such a system, however, has the disadvantage of crushing the hard material into very small granules or even dust, when larger particles would have been preferred. Such an arrangement is inefficient since more energy is needed to reduce the hard material to dust than to lumps of variable size. The removal of such lumps of hard material from the site of drilling is also easier and more efficient than removal of equivalent amounts of fine dust.

The drill bits of the prior art also suffer from rapid loss of an effective cutting edge because the prior designs of such bits provide that always the same area of cutting edge is in contact with the hard material to be drilled. As a result, such drill bits require frequent sharpening or replacement.

An object of the present invention is therefore to provide a drill bit which granulates hard material to produce chunks instead of small granules or dust.

Another object of the invention is to provide a drill bit wherein the section of the cutting edges contacting the surface to be drilled, continously change, thereby avoiding the rapid deterioration of sharpness mentioned above.

Accordingly the invention provides a drill bit for use with a reciprocating device, comprising:

(a) a mounting post designed to attach to the reciprocating device and to be reciprocated by said reciprocating device in the direction of its longitudinal axis;

(b) a U-shaped member having two arms and a base which is attached to one end of the mounting post;

(c) a corrugated frusto-conical roller for striking a surface to be drilled, and mounted between the arms of the U-shaped member on an axle so that it is rotatable about its geometrical axis, the corrugations being alternating peaks and furrows, each peak being tipped with a hard material and defining a circle, the circles being concentric about the roller's geometrical axis and having diameters which decrease from one end of the roller to its other end; and wherein said axle is so oriented that the free end of the drill bit is formed by aligned points of the peaks which define an imaginary line substantially perpendicular to the direction of reciprocation of the mounting post.

The drill bit according to the invention is for use with any known reciprocating device such as the hydraulic/-pneumatic hammers disclosed in UK patent application GB No. 2 108 594 A (published 18-5-86) or with the drill head and impact hammer system disclosed in Canadian Pat. No. 1,133,954, or with the drilling apparatus disclosed in U.S. Pat. No. 4,682,819. Such devices may for example be hydraulically, pneumatically or electrically powered.

The present invention overcomes the difficulties of the prior art by causing the material to be drilled to break off in lumps.

This is achieved by a characteristic of the new design which allows that the force imparted to the drill bit by the reciprocating device is not equally spread over the length of the roller section of the drill bit when striking the hard material to be drilled. Instead, due to the difference in diameter of the peaks, the force imparted by each peak on the roller to the surface to be drilled is different from the next and reduces gradually along the length of the roller with the peak of greatest diameter imparting the greatest force. This inequality of applied force as well as the difference in diameter of the peaks cause the material to be drilled to crumble under much less overall force.

Another advantage of the present invention is that the shape of the drill bit causes force to be transmitted via the corrugated peaks at an angle to the surface to be impacted. This facet again renders the material to be drilled more susceptible to crumbling since the force applied is not perpendicular to the impacted surface.

In this invention the roller is rotatable about its axis thereby allowing different parts of the cutting ridges to be in contact with the surface to be imparted at every strike of the reciprocating device. This provision means that the cutting edges, because they lie in series, circumferentially along the roller, have increased area (compared with the prior art) of potential contact with the impacted surface, thereby lengthening their useful lifetime, and concomitantly allowing sharp edges to be maintained longer.

The objects, advantages and other features of the present invention will become more apparent upon reading of the following non-restrictive description of a preferred embodiment thereof, made within reference to the accompanying drawings; in which.

Figure 1:
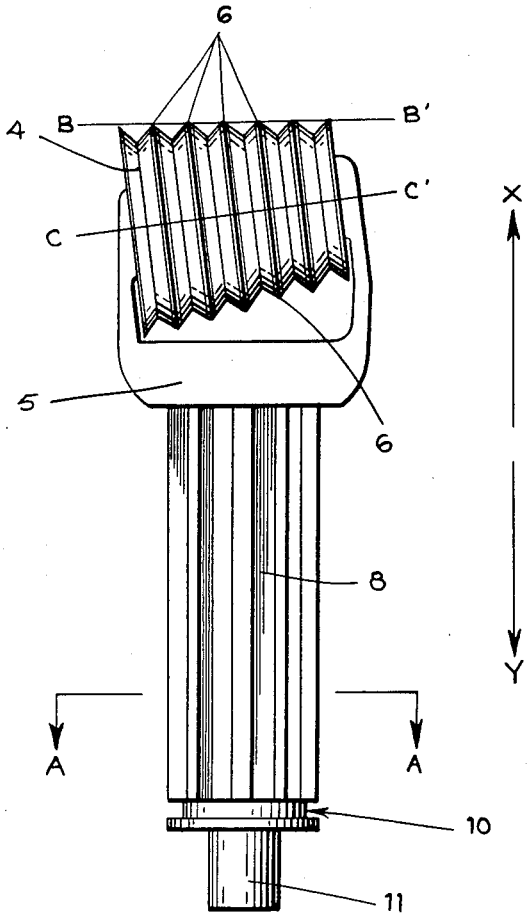
FIG. 1 is a side elevation of the drill bit.
Figure 2:
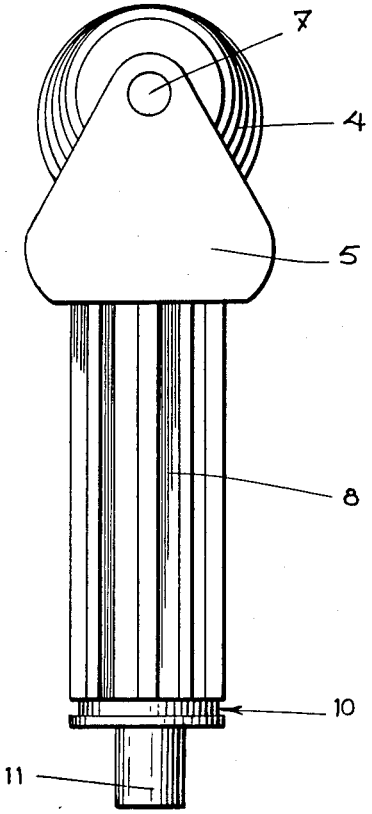
FIG. 2 is also a side elevation of the drill bit but viewed at 90° to the elevation shown in FIG. 1.

In FIGS. 1 and 2, the frusto-conical roller (4), including corrugations formed by alternating peaks and furrows, is mounted between the arms of a U-shaped member (5) on an axle (7) which runs along the geometrical axis CC′ of the roller (4). The axle (7) is surrounded by roller bearings and rings of ball bearings (not shown) within the roller, enabling the roller to rotate freely about its geometrical axis. The axle and the bearings are strong enough to withstand the impacting stresses to which they are subjected. Otherwise, the axle and bearings are of any design commonly known in the art and are therefore not further described here. The roller is preferably made from tempered steel.

The U-shaped member (5) is designed so that it retains the roller (4) through the axle (7) so that the peaks (6) of the corrugated roller include striking points defining the free end of the drill bit and located along an imaginary line BB′, which is substantially perpendicular to the direction of reciprocation of the mounting post (8).

The angle of the geometrical axis of the roller to the imaginary line BB′ is variable and may be chosen to select the desired gradation of forces imparted by each peak (6) along the length of the roller (4).

The cutting edges (teeth) on the roller are sited at the peaks (6) of the corrugations and may be made from material suitable for whatever hard material it is desired to fragment. However, it is preferred that the cutting teeth (6) are carbide tipped. The number of teeth may be varied but the preferred number is seven.

The drill head shown in FIGS. 1 and 2 can be attached to any impacting device as explained above, so that the bit is caused to move alternately in opposite directions X and Y (see FIGS. 1 and 2). From FIG. 1 it is therefore clear that the cutting teeth (6) of the roller (4) meet the surface to be impacted at a slight angle to the perpendicular. This results in shock waves penetrating the hard material being drilled in an asymmetrical manner thereby causing fragmentation to occur more easily than if the impact were perpendicular.

Figure 3:
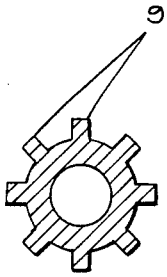
FIG. 3 is a cross section along the line AA marked on FIG. 1, showing the spline configuration on the mounting post.

The U-shaped member (5) which retains the roller (4) is attached to one end of a mounting post (8) which carries splines (9) so that in cross-section —see FIG. 3—the mounting post has the aspect of a cog. This embodiment prevents rotational movement of the bit while allowing guided percussive movement of the same. When this embodiment is employed, the bit is suitable for mounting, for example, in an hydraulic reciprocating device of the type disclosed in U.K. application GB No. 2 108 594 A which describes a similar mounting arrangement using splines.

The mounting post (8) carries an indented ring (10) towards its proximal end, to facilitate attachment to the desired impacting tool. Such an indented ring (10) normally provides a recess into which fit two half-annuli attached to the impacting tool employed (not shown), in order to secure the bit firmly while the device undergoes reciprocal longitudinal motion.

Finally at the proximal end of the drill bit of the present invention there may be provided a bit valve (11) which allows percussive action of some types of reciprocating device or hammer which can be used in conbination with the drill bit.

Although the present invention has been described hereinabove by means of a preferred embodiment thereof, it should be pointed out that any modification to this preferred embodiment, within the scope of the appended claims, is not deemed to change or alter the nature of the invention.

I claim:

1. A drill bit for use with a reciprocating device, comprising:

(a) a mounting post having an upper end and a lower end, said post having its upper end designed for attachment to the reciprocating device so as to be reciprocated by said reciprocating device in the direction of its longitudinal axis;

(b) a U-shaped member having two arms and a base attached to the lower end of the mounting post;

(c) a single corrugated frusto conical roller for striking a surface to be drilled, said roller being mounted between the arms of the U-shaped member on an axle so that said roller is rotatable about is geometrical axis, the axis of said post as extended intersecting the central portion of said roller, the corrugations being alternating peaks and furrows, each peak being tipped with a hard material and defining a circle, the circles being concentric about the roller's geometrical axis and having diameters which decrease from one end of the roller to its other end; said axle being oriented so that aligned points on the peaks of the roller at the drilling end of the drill bit define an imaginary line substantially perpendicular to the direction of reciprocation of the mounting post.

2. A drill bit according to claim 1 wherein the corrugations are alternating peaks and furrows of equal spacing.

3. A drill bit according to claim 1, wherein the axle runs inside the frusto-conical roller along its geometrical axis, and comprises ends which are respectively attached to a corresponding arm of the U-shaped member.

4. A drill bit according to claim 1 wherein the frusto-conical roller is mounted on said axle through ball bearings and roller bearings.

5. A drill bit acording to claim 1 wherein the roller is made from tempered steel.

6. A drill bit according to claim 1, wherein the peaks are tipped with carbide.

7. A drill bit according to claim 1, further comprising means to prevent rotation of the mounting post, said means disposed on the upper end of said mounting post.

8. A drill bit according to claim 1, further comprising a retaining means towards the upper end of said mounting post.

9. A drill bit according to claim 1 wherein the mounting post carries in its upper end a bit valve.

10. A drill bit according to claim 8, wherein said means to prevent rotation comprises a spline arrangement.

11. A drill bit according to claim 9, wherein said retaining means is an indented ring able to receive securing means on said reciprocating device.

* * * * *